US005722936A

United States Patent [19]

Trulio

[11] Patent Number: 5,722,936

[45] Date of Patent: Mar. 3, 1998

[54] VETERINARY AVIAN ORAL SPECULUM AND METHOD OF USE

[76] Inventor: Bruce S. Trulio, 525 Sixth St., Annapolis, Md. 21403

[21] Appl. No.: 688,510

[22] Filed: Jul. 30, 1996

[51] Int. Cl.[6] ..... A61D 15/00

[52] U.S. Cl. ..... 600/243; 600/237; 119/715; 119/833

[58] Field of Search ..... 600/184, 235, 600/237, 238, 243; 433/1, 140; 119/713, 714, 715, 833

[56] References Cited

U.S. PATENT DOCUMENTS

| | | | |
|---|---|---|---|
| 1,875,158 | 8/1932 | Rombough | 600/243 |
| 3,568,664 | 3/1971 | Meriwether | 600/243 |
| 4,971,557 | 11/1990 | Martin | 433/140 |
| 5,199,418 | 4/1993 | Jamison, Jr. et al. | 600/243 |

*Primary Examiner*—Jeffrey A. Smith
*Attorney, Agent, or Firm*—Leonard Bloom

[57] ABSTRACT

A veterinary oral speculum for use with a bird is a rod having a cut away portion formed in a first longitudinal surface near one end of the rod and defining a handle at the opposite end of the rod. A slotted hole is formed in an opposite second longitudinal surface of the rod. The slotted hole and the cut-away portion are opposed to and communicate with one another and form a through opening in the rod. The speculum is inserted between the mandibles of the bird, rotated through 90° and slid within the mouth of the bird so that the slotted hole is oriented inwardly toward the bird, the cut away portion is oriented outwardly from the bird and the through opening is oriented between the mandibles as a window such that oral access to the bird is gained by the through opening.

15 Claims, 8 Drawing Sheets

VETERINARY AVIAN ORAL SPECULUM AND METHOD OF USE

BACKGROUND OF THE INVENTION

The present invention relates to a speculum and more particularly to a speculum for oral examination of birds.

BRIEF SUMMARY OF THE INVENTION

During veterinary examination of birds, it is necessary to open the mandibles (the beak) of the bird for an oral examination to the mouth, throat and interior of the beak. This can be very difficult and dangerous to the person conducting the examination. A macaw can develop a bite of 800 to 1500 psi. In contrast a German shepherd dog on exerts a pressure of 275 psi. In addition the beak is sharp and can result in serious injury to a person if the bird clamps its beak on the person's finger.

The known device for opening the beak of a bird is a metal wire or rod which is bent to accommodate birds having beaks of differing sizes. The known device frequently slips, resulting in injury to the person conducting the examination. Also, the device is objectional to the birds and the birds often are injured when the mandibles of the bird clamp on the metal device. This is extremely serious because large birds, such as macaws, cannot survive without the use of their mandibles.

There is a need for a device which is acceptable to the bird and protects both the bird and the person examining the bird.

BRIEF SUMMARY OF THE INVENTION

It is an object of the present invention to provide an avian oral speculum which permits a person to open the mandibles of the bird without injury to the bird or the person.

It is a further object of the present invention to provide an avian speculum made from a material with which a bird is familiar, is easily fabricated, is relatively inexpensive and is available for use with birds of various sizes.

In accordance with the teachings of the present invention there is a disclosed a veterinary oral speculum for use with a bird having an upper mandible and a lower mandible, the speculum includes a rod having a length, a height, a first end, an opposite second end, a first longitudinal surface and a second opposite longitudinal surface. A cut away portion is formed on the first longitudinal surface defining a wall section between the first longitudinal surface and the second longitudinal surface. The wall section has a height less than the height of the rod. The cut away portion has a first end near the first end of the rod and a second end distal from the first end of the rod. A slotted hole is formed in the second longitudinal surface of the rod, wherein the slotted hole and the cut away portion are opposed to and communicate with one another forming a through opening in the height of the rod. The wall section of the speculum is inserted between the upper mandible and the lower mandible of the bird. The mandibles are disposed between the first end at the second end of the cut away portion. The rod is rotated through 90°, the mandibles are separated, such that the slotted hole is oriented inwardly toward the bird and the cut away portion is oriented outwardly from the bird with the through opening oriented between the mandibles as a window. Oral access to the bird is gained by means of the through opening.

Viewed in another aspect, there is disclosed a veterinary oral speculum for use with a bird having an upper mandible and a lower mandible. The speculum includes a rod having a handle, an intermediate portion an end opposite from the handle, a first longitudinal surface and a second opposite longitudinal surface. The intermediate section has a cut away portion formed in the first longitudinal surface between the handle and the end. The intermediate section further has a slotted hole formed in the second longitudinal surface in juxtaposition to the handle. The slotted hole is opposed to and communicates with the cut away portion, a through opening is thereby formed in the intermediate portion between the slotted hole and the cut away portion. When the speculum is inserted between the upper mandible and the lower mandible of the bird, the cut away portion is juxtapositioned to the lower mandible and the slotted hole in juxtapositioned to the upper mandible. The speculum is rotated through approximately 90°, thereby separating the mandibles such that the slotted hole is oriented inwardly toward the bird and the cut away portion is oriented outwardly from the bird, with the through opening oriented between the mandibles. In this manner oral access to the bird is gained by means of the through opening.

In still another aspect of the present invention, there is disclosed a method for an examiner using a veterinary avian speculum to gain oral access to a bird having an upper mandible and a lower mandible on the bird's head. The method includes the steps of providing an avian speculum. The avian speculum is a rod having a length, a height, a first end, an opposite second end, a first longitudinal surface, and a second opposite longitudinal surface. A cut away portion is formed on the first longitudinal surface near the first end of the rod and defining a wall section between the first longitudinal surface and the second longitudinal surface. The wall section has a height which is less than the height of the rod. The cut away portion has a first end near the first end of the rod and a second end distal from the first end of the rod. A slotted hole is formed in the second longitudinal section of the rod. The cut away portion and the slotted hole are opposed to, and communicate with one another forming a through opening in the rod. The slotted hole and the cut away portion each having a respective length, the length of the slotted hole being less than the length of the cut away portion. The slotted hole is disposed near the second end of the cut away portion. The head of the bird is stabilized by the examiner. The second end of the rod is picked up by the examiner, the rod being held with the cut away portion above the slotted hole. The wall section of the rod near the first end of the rod is inserted between the upper mandible and the lower mandible of the bird. The rod is rotated through approximately 90° wherein the mandibles are separated, the slotted hole on the rod being oriented inwardly toward the bird and the cut away portion being oriented outwardly from the bird. In this manner the through opening in the rod is available as a window to the person. Oral access to the bird is gained by means of the through opening.

These and other objects of the present invention will become apparent from a reading of the following specification, taken in conjunction with the enclosed drawings.

DESCRIPTION

Figure 1:
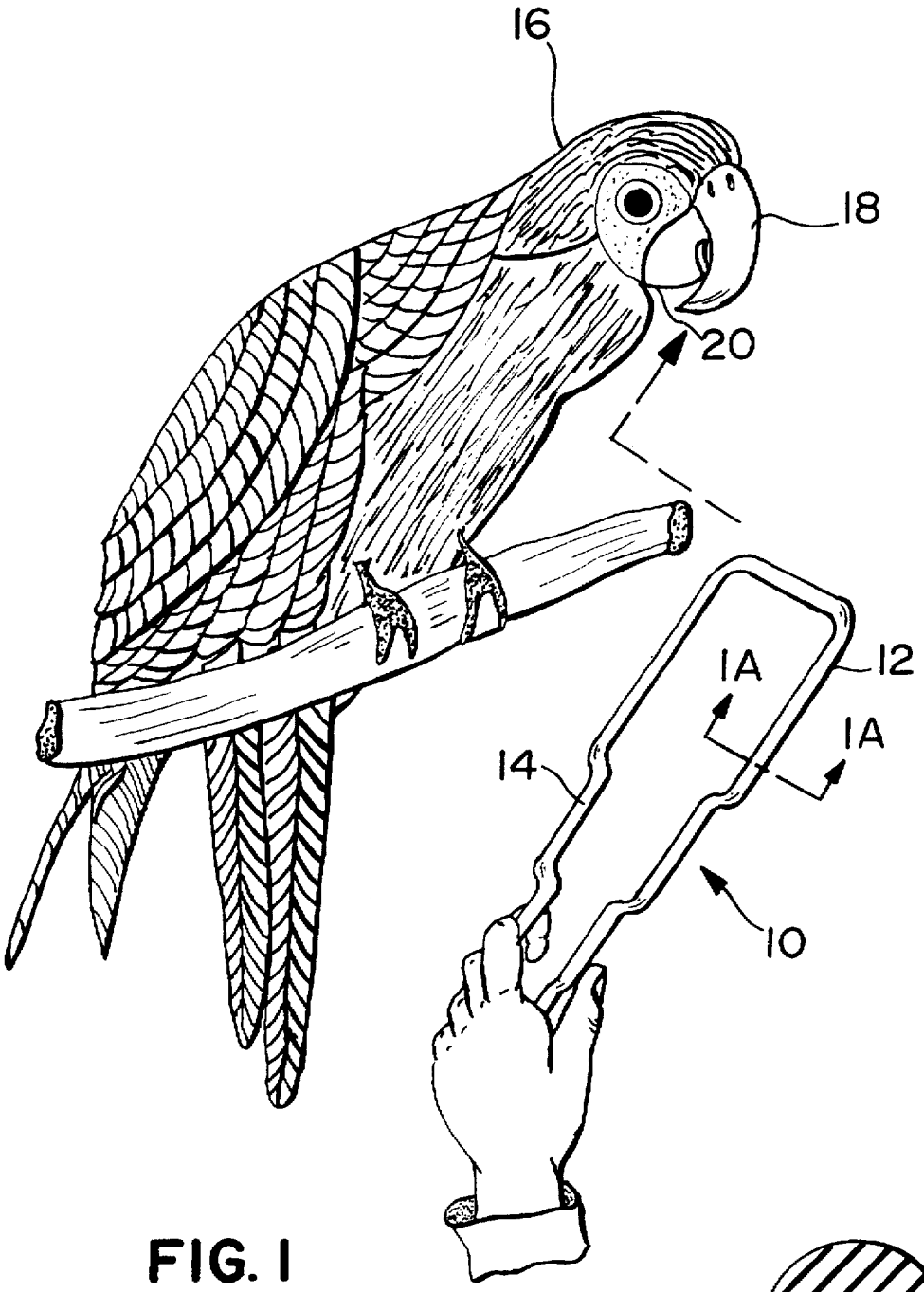
FIG. 1 PRIOR ART
FIG. 1 is a perspective view of the device of the prior art to be inserted into the beak of a bird.
Figure 1A:
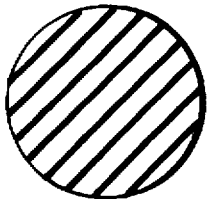
FIG. 1A PRIOR ART
FIG. 1A is a cross sectional view across the lines 1A—1A of FIG. 1.
Figure 2:
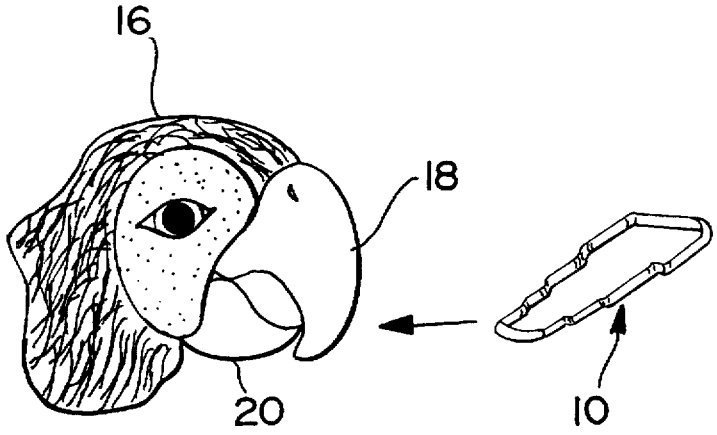
FIG. 2 PRIOR ART
FIG. 2 is a perspective view of the device of the prior art showing the device before insertion into the bird's beak.
Figure 3:
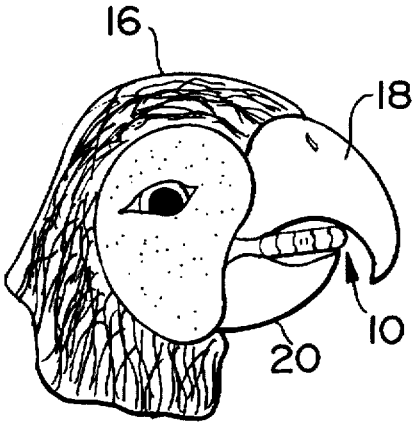
FIG. 3 PRIOR ART
FIG. 3 is a side view of the device of the prior art received horizontally into the beak of the bird.
Figure 4:
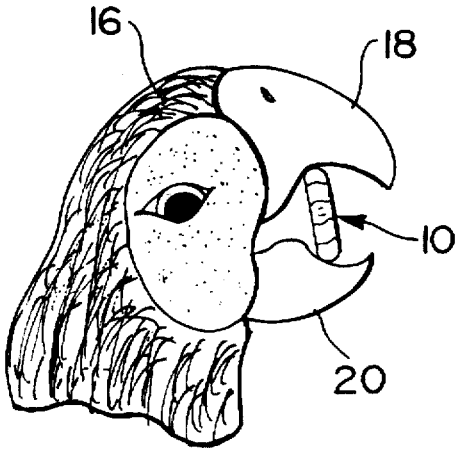
FIG. 4 PRIOR ART
FIG. 4 is a side view of the device of the prior art rotated into a vertical position and separating the upper mandible and the lower mandible of the bird.
Figure 5:
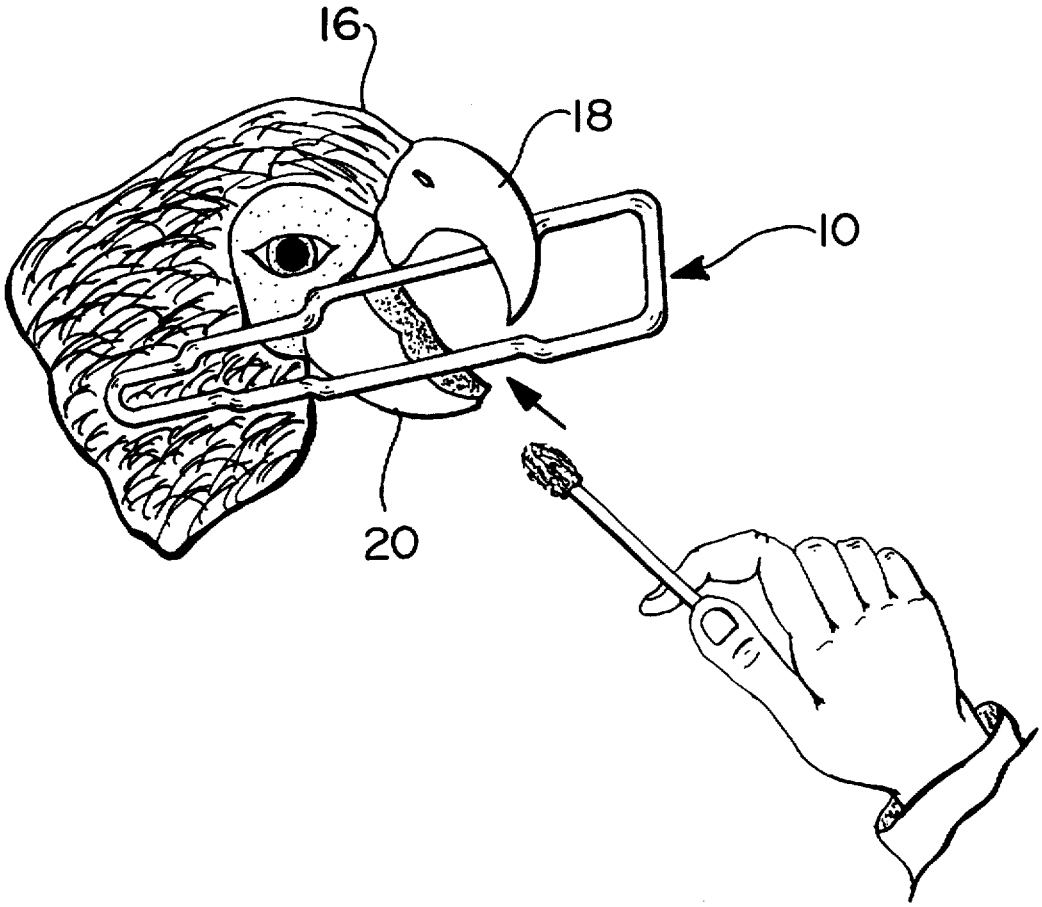
FIG. 5 PRIOR ART
FIG. 5 is a perspective view of a bird having the device of the prior art in the bird's beak wherein an oral examination of the bird is possible.
Figure 6:
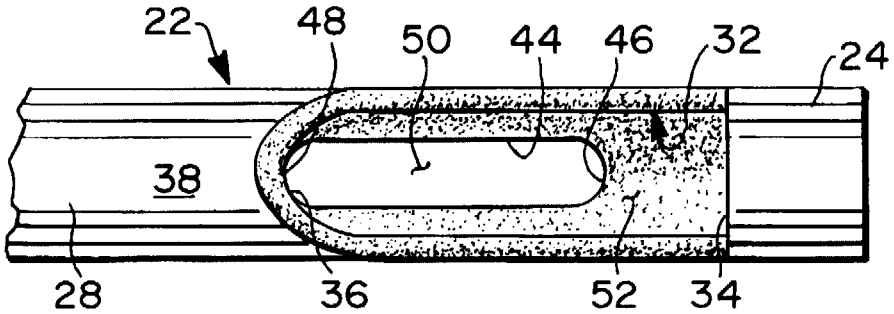
FIG. 6 is a top plan view of the speculum of the present invention.
Figure 7:
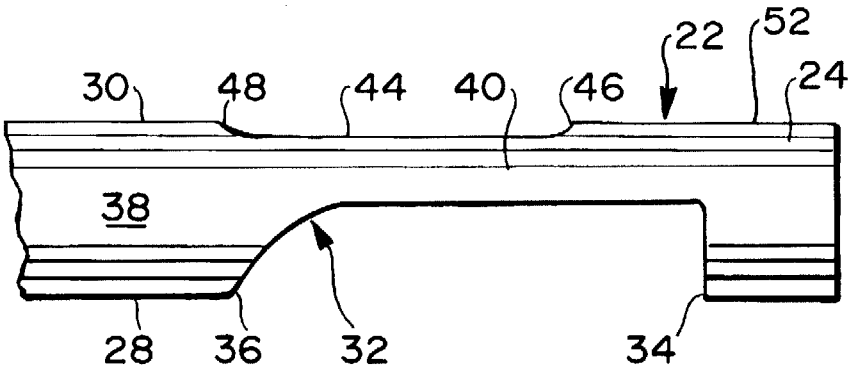
FIG. 7 is a side elevation view of the speculum of the present invention.
Figure 8:
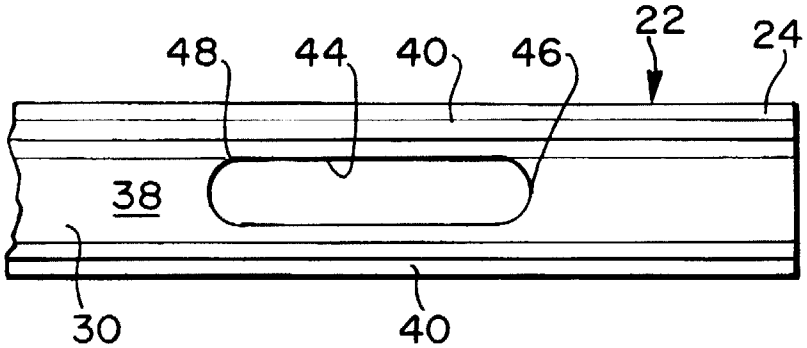
FIG. 8 is a bottom plan view of the speculum of the present invention.
Figure 9:
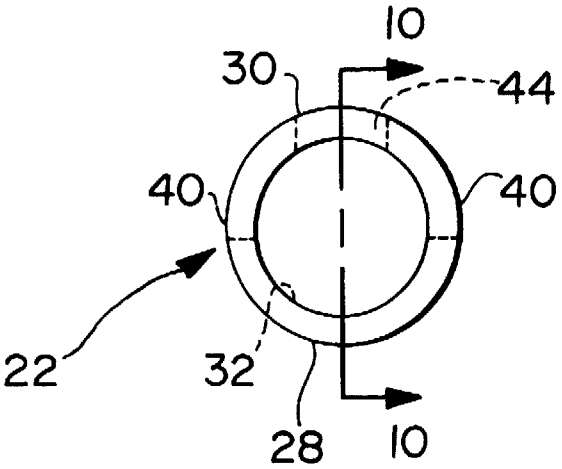
FIG. 9 is an end view of the speculum of the present invention.
Figure 10:
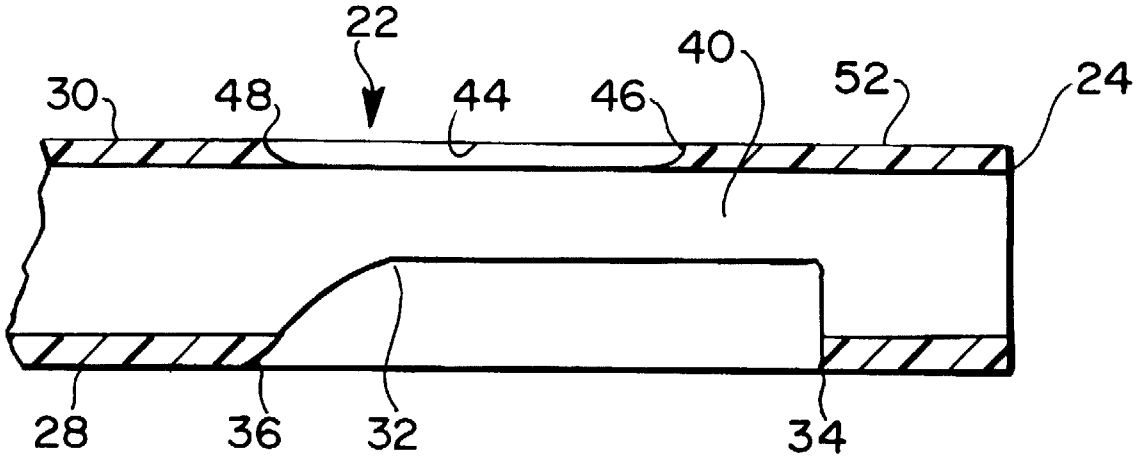
FIG. 10 is a cross sectional view across the lines 10—10 of FIG. 9.

Referring now to FIGS. 1–5, the prior art is a metal (stainless steel) wire or rod frame 10 which has a series of increasing larger segments. The smaller segment 14 is used as a handle for the person working with the bird 16. The segment having a dimension most closely corresponding to the dimension of the opened beak of the bird 16 is inserted horizontally between the mandibles of the bird. For example, for a large bird (macaw), the largest segment 12 would be used. With medium size parrots, a smaller segment would be used. The device is then rotated approximately 90° to force apart the upper mandible 18 from the lower mandible 20 of the bird and to maintain the mandibles in the separated position. The open area of the frame within the metal rod provides access to the mouth, throat and interior of the beak of the bird so that a veterinarian or other person can examine or treat the bird.

However, the metal frame 10 often slips because of the unstable nature of the frame in the bird's beak. When the frame slips, a person examining the bird can be seriously injured by the bird's beak. Also, the bird can suffer damage to the beak or other parts of the bird's mouth. Furthermore, birds do not like the feel of the unfamiliar metal rod and resist insertion of the device. This increases the possibility of injury to the veterinarian and to the bird.

The speculum 22 of the present invention is a substantially straight rod having a length, a height, a first end 24, and opposite second end 26, a first longitudinal surface 28 and a second longitudinal surface 30 opposite to the first longitudinal surface 28. (FIGS. 6–10)

A cut away portion 32 is formed in the first longitudinal surface 28 at an intermediate portion of the speculum 22. The cut away portion 32 has a first end 34 which is proximal to the first end 24 of the speculum 22 and a second end 36 which is distal from the first end 24 of the speculum 22. The second end 36 of the cut away portion 32 preferably is near the mid-point 38 of the speculum 22. Formation of the cut away portion 32 defines a wall section 40 between the first longitudinal surface 28 and the second longitudinal surface 30. The wall section 40 is formed on both sides of the cut away portion 32. The wall section 40 has a height which is less than the height of the speculum 22 and preferably, is approximately one half (½) to three quarters (¾) of the height of the speculum 22 (FIGS. 6–9 and 14–16). It is preferred that the wall section 40 is two-thirds (⅔) of the height of the speculum 22.

The portion of the speculum 22 between the second end 36 of the cut away portion 32 and the second end 26 of the speculum 22 serves as a handle 42 for the person using the speculum 22. The first end 24 has the full cross sectional dimension of the rod.

Figure 14:
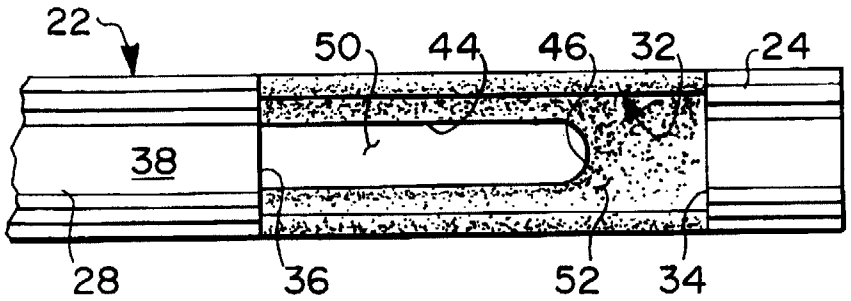
FIG. 14 is a top plan view of an alternate embodiment of the present invention.
Figure 15:
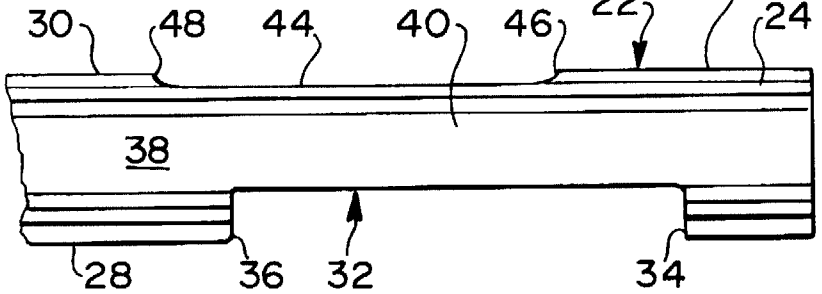
FIG. 15 is a side elevation view of the embodiment of FIG. 14.
Figure 16:
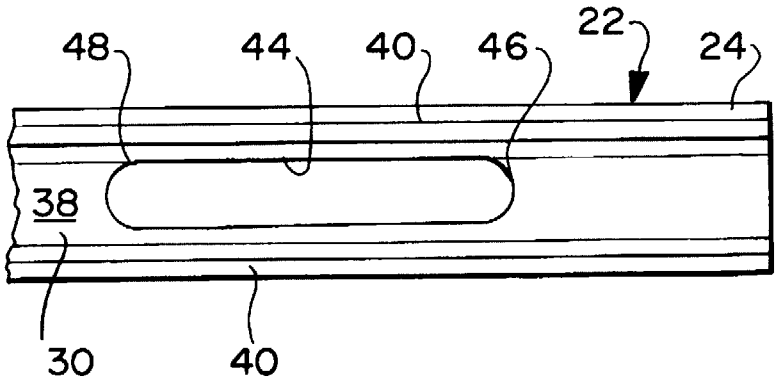
FIG. 16 is a bottom plan view of the embodiment of FIG. 15.

A slotted hole 44 is formed in the second longitudinal surface 30 of the speculum 22. The slotted hole 44 has a first end 46 and a second opposite end 48. The slotted hole 44 and the cut away portion 32 are diametrically opposed to one another and communicate with one another thereby forming a through opening 50 in the height of the speculum 22. The length of the slotted hole 44 is less than the length of the cut away portion 32. In one embodiment, the second end 48 of the slotted hole 44 is aligned with the second end 36 of the cut away portion 32 and in approximately at the mid-point of the length of the speculum 22. Alternately, the second end 48 of the slotted hole 44 is disposed closer to the second end 26 of the rod than the second end 36 of the cut away portion 32, the respective second end 48 of the slotted hole 44 being offset from the second end 36 of the cut away portion 32 (FIG. 14–16). The offset embodiment permits better viewing of the interior of the birds mouth and beak. The second end 36 of the portion 38 (FIGS. 6, 7 and 10) or it may be substantially perpendicular to the first longitudinal surface 28 (FIGS. 15 and 16). In this manner, there is defined a segment 52 of the second longitudinal surface 30 which extends from the first end 46 of the slotted hole 44 to the first end 24 of the speculum 22. It is further preferred that the width of the slotted hole 44 is approximately one-half (½) the width of the cut away portion 32 although this dimensional relationship is not essential.

The rod from which the speculum 22 is formed may be a solid rod or a tube with a longitudinal center bore therethrough, and may have a cross section which is circular, oval, square, rectangular or polygonal.

It is preferred that the speculum 22 be made from a plastic material to reduce the possibility of injury to the bird. Polyvinyl chloride is particularly preferred because perches are made from this plastic and the birds are familiar and comfortable with the material. Birds frequently grasp the polyvinyl chloride perches with their beaks and hang from the perches so that the birds do not object to this material being placed in their beaks. In addition, polyvinyl chloride pipes and rods are commercially available in several diameters which facilitates manufacture of the speculum, are economical, are non-toxic and provides different cross sectional dimensions to be used for speculums for different size birds.

Figure 11:
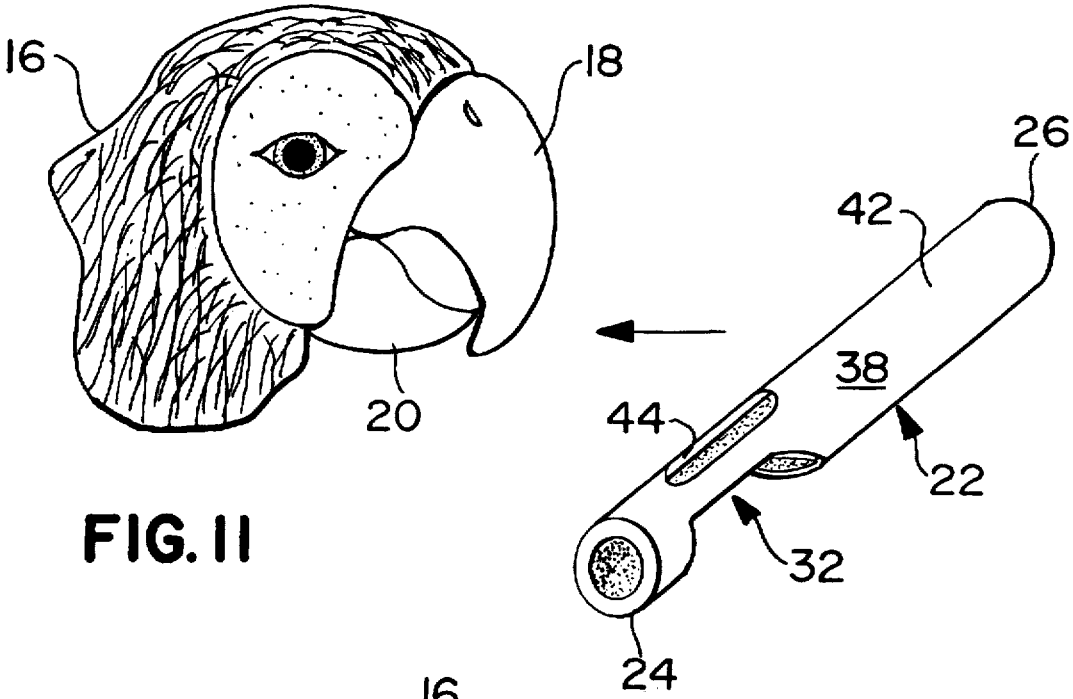
FIG. 11 is a perspective view showing the speculum of the present invention to be inserted in the beak of a bird.
Figure 12:
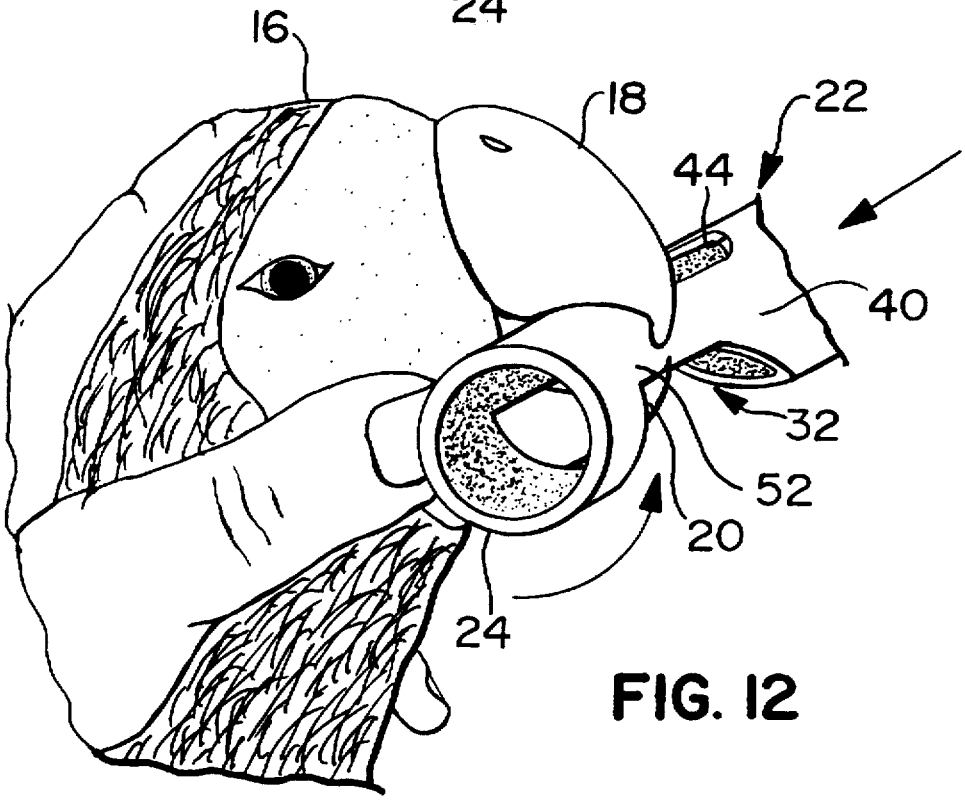
FIG. 12 is a perspective view of the speculum of the present invention received between the mandibles of the bird.
Figure 13:
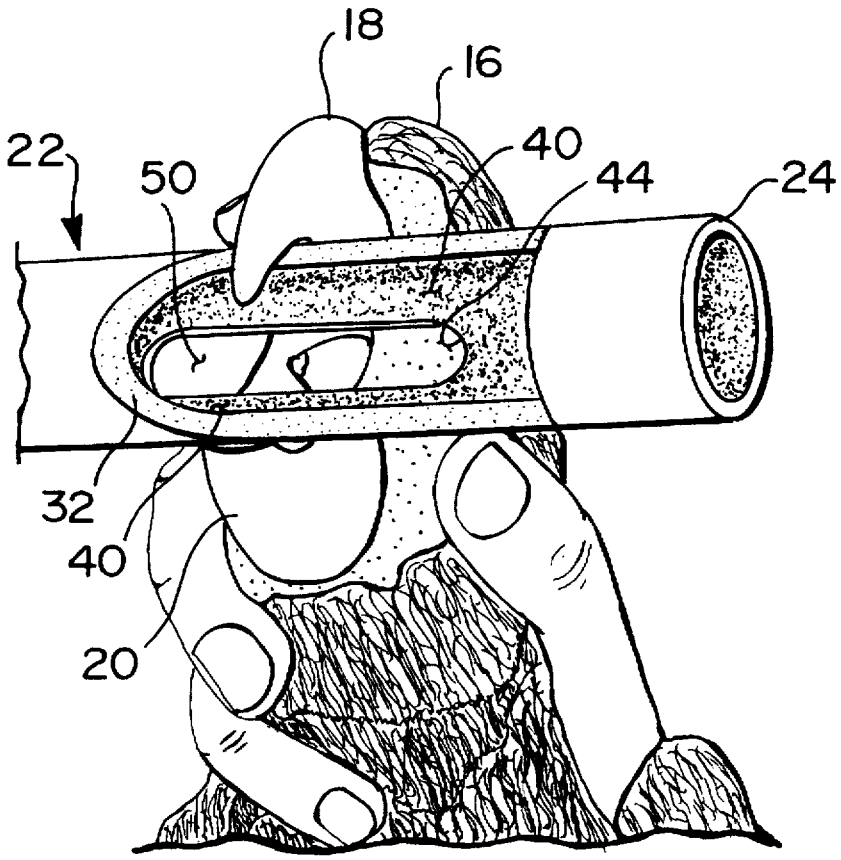
FIG. 13 is a perspective view showing the speculum of the present invention in the bird's beak with the mandibles separated and a through opening to gain access for an oral examination.

Referring now to FIGS. 11–13, after the bird is immobilized by a holder, the speculum 22 of the present invention is used by the examiner stabilizing the head of the bird with one hand and grasping the handle 42 of the speculum 22 with the other hand. The speculum 22 is held with the first longitudinal surface 28 below the second longitudinal surface 30 so that the cut away portion 32 is below the slotted hole 44. In this manner, the cut away portion 32 is aligned with the bird's upper mandible 18 and the slotted hole is aligned with the bird's lower mandible 20.

The wall section 40 near the first end 24 of the speculum 22 is inserted between the upper mandible 18 and the lower mandible 20 of the bird. The segment 52 of the second longitudinal surface 30 is embraced by the upper mandible of the bird and the mandibles avoid the slotted hole 44 so as to prevent injury to the bird. The cut away portion 32 is juxtapositioned to the upper mandible 18 and the segment 52 on the second longitudinal surface is juxtapositioned to the lower mandible 20.

The speculum 22 is rotated through approximately 90° in a camming manner, thereby separating and forcing apart the mandibles of the bird. The direction of rotation is to orient the slotted hole 44 inwardly toward the interior of the mouth of the bird and to orient the cut away portion 32 outwardly from the interior of the mouth of the bird. The speculum 22 is slid sideways in the beak of the bird so that the slotted hole 44 is received in the mouth of the bird between the mandibles. The mandibles of the bird are supported on the wall section 40 during this sliding movement thereby assuring that the beak is not engaged in the slotted hole 44 or in the cut away portion 32 and injury to the bird is avoided. The speculum 22 is now properly oriented in the mouth of the bird with the slotted hole 44 directed to the interior of the bird's throat and the cut away portion 32 directed to the person treating the bird and the through opening 50 is oriented into the bird's open mouth between the upper mandible 18 and the lower mandible 20. Oral access to the throat, mouth and interior of the beak of the bird is gained through the through opening 50 which serves as a window.

It is preferred that the speculum 22 be inserted into the bird's beak with the second longitudinal surface 30 above the first longitudinal surface 28 in order to avoid accidental engagement of the larger upper mandible 18 in the slotted hole 44 or the cut away portion 32. It is possible to insert the speculum 22 into the bird's beak with the second longitudinal surface 30 below the first longitudinal surface 28, but care is required to prevent the mandibles of the bird from being engaged in the slotted hole 44 or the cut away portion 32.

The present invention avoids the slippage problem of the prior art because the bird's mandibles are not contacting a wire frame which can slip or rotate at any time the device is in the beak of the bird. In the present invention, a narrower portion of the speculum 22, namely the wall section 40 is inserted in the beak of the bird and the lower mandible is disposed on the wall section 40 between the ends of the cut away portion 32, the ends being elevated with respect to the wall section 40. Thus, slippage before rotation is not possible. When the speculum 22 is rotated, the wall section 40 serves as a cam in that the height of the wall section 40 is approximately one-half (½) to three quarters (¾) of the height of the speculum 22. Thus the mandibles are initially opened by a distance which is approximately one-half (½) to three quarters (¾) of the height of the speculum 22. Depending upon the cross-section height of the speculum 22, this opening distance can be varied by selection of a speculum 22 with dimensions appropriate for the size of the bird. Furthermore, the plastic material from which the speculum 22 of the present invention is made is less liable to slip as compared to the metal from which the prior devices are fabricated.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. A veterinary oral speculum for use with a bird having an upper mandible and a lower mandible, the speculum comprising:

a rod having a length, a height, a first end, an opposite second end, a first longitudinal surface and a second opposite longitudinal surface, a cut away portion being formed on the first longitudinal surface defining a curved wall section between the first longitudinal surface and the second longitudinal surface, the curved wall section having a height less than the height of the rod, the cut away portion having a first end proximal to the first end of the rod and a second end distal from the first end of the rod, a slotted hole being formed in the second longitudinal surface of the rod, wherein the slotted hole and the cut away portion are opposed to and communicate with one another forming a through opening in the height of the rod, said speculum having no movable parts.

wherein, the curved wall section of the speculum is inserted between the upper mandible and the lower mandible of the bird the mandibles being disposed between the first end and the second end of the cut away portion, the rod being rotated through 90°, the mandibles being separated such that the slotted hole is oriented inwardly toward the bird and the cut away portion is oriented outwardly from the bird with the through opening oriented between the mandibles as a window such that oral access to the bird is gained by means of the through opening.

2. The speculum of claim 1, wherein the rod is hollow having a bore through the length thereof.

3. The speculum of claim 1 further comprising the cut away portion being formed near the first end of the rod and extending approximately one-half the length of the rod, thereby forming a handle between the cut away portion and the second end of the rod.

4. The speculum of claim 1, wherein the rod is formed of a plastic material.

5. The speculum of claim 4, wherein the plastic material is polyvinyl chloride.

6. The speculum of claim 1, wherein the height of the wall section ranges from approximately one-half to three-quarters of the height of the rod.

7. A veterinary oral speculum for use with a bird having an upper mandible and a lower mandible, the speculum comprising:

a rod having a length, a height, a first end, an opposite second end, a first longitudinal surface and a second opposite longitudinal surface, a cut away portion being formed on the first longitudinal surface defining a wall section between the first longitudinal surface and the second longitudinal surface, the wall section having a height less than the height of the rod, the cut away portion having a first end proximal to the first end of the rod and a second end distal from the first end of the rod, a slotted hole being formed in the second longitudinal surface of the rod, wherein the slotted hole and the cut away portion are opposed to and communicate with one another forming a through opening in the height of the rod, wherein the wall section of the speculum is inserted between the upper mandible and the lower mandible of the bird the mandibles being disposed between the first end and the second end of the cut away portion, the rod being rotated through 90°, the mandibles being separated such that the slotted hole is oriented inwardly toward the bird and the cut away portion is oriented outwardly from the bird with the through opening oriented between the mandibles as a window such that oral access to the bird is gained by means of the through opening, wherein the slotted hole and the cut away portion each have a respective length, the length of the slotted hole being less than the length of the cut away portion, thereby defining a segment of the second longitudinal surface between the slotted hole and the first end of the rod.

8. A veterinary oral speculum for use with a bird, the speculum comprising:

a tube having a first end, an opposite second end, a midpoint therebetween, a first longitudinal surface and a second opposite longitudinal surface, a cut away portion being formed in the first longitudinal surface from near the first end of the tube extending to approximately the mid point of the tube, a slotted hole being formed in the second longitudinal surface wherein the slotted hole and the cut away portion are opposed to and communicate with one another forming a through opening in the tube, the cut away portion and the slotted hole each having a respective length, the length of the cut away portion being greater than the length of the slotted hole wherein the speculum being inserted between an upper mandible and a lower mandible of the bird, the cut away portion being juxtapositioned to the lower mandible, the second longitudinal surface being juxtapositioned to the upper mandible, the speculum being rotated through approximately 90°, thereby separating the mandibles such that the slotted hole is oriented inwardly toward the bird and the cutaway portion is oriented outwardly from the bird, with the through opening oriented between the mandibles as a window such that access to the bird is gained by means of the through opening.

9. The speculum of claim 8, wherein the tube is made of a plastic material.

10. A method using a veterinary avian speculum, for an examiner to gain oral access to a bird having an upper mandible and a lower mandible on the bird's head comprising the steps of:

providing an avian speculum, said speculum being a rod having a length, a height, a first end, an opposite second end, a first longitudinal surface, and a second opposite longitudinal surface, a cut away portion being formed on the first longitudinal surface near the first end of the rod and defining a wall section between the first longitudinal surface and the second longitudinal surface, the wall section having a height less than the height of the rod, the cut away portion having a first end near the first end of the rod and a second end distal from the first end of the rod, a slotted hole being formed in the second longitudinal section of the rod, the cut away portion and the slotted hole being opposed to, and communicating with one another forming a through opening in the rod, the slotted hole and the cut away portion each having a respective length, the length of the slotted hole being less than the length of the cut away portion, the slotted hole being disposed near the second end of the cutaway portion, stabilizing the head of the bird by the examiner picking up the second end of the rod by the examiner, the rod being held with the cut away portion above the slotted hole, inserting the wall section of the rod near the first end of the rod between the upper mandible and the lower mandible of the bird, rotating the rod through approximately 90° wherein the mandibles are separated, the slotted hole on the rod being oriented inwardly toward the bird and the cutaway portion being oriented outwardly from the bird, the through opening in the rod being available as a window, and gaining oral access to the bird by means of the through opening.

11. The method of claim 10, wherein a segment is defined on the second longitudinal surface between the slotted hole and the first end of the rod, the rod being inserted between the mandibles of the bird such that the mandibles embrace the segment of the second longitudinal surface, contact the wall section and avoid the slotted hole, the rod being slid between the mandibles after rotation of the rod to prevent the mandibles from being engaged in the slotted hole and in the cutaway portion.

12. A veterinary oral speculum for use with a bird, having an upper mandible and a lower mandible, the speculum comprising:

a rod having a handle, an intermediate portion, an end opposite from the handle, a first longitudinal surface and a second opposite longitudinal surface, the intermediate section having a cut away portion formed in the first longitudinal surface between the handle and the end, the intermediate section further having a slotted hole formed in the second longitudinal surface in juxtaposition to the handle, the slotted hole being opposed to and in communication with the cut away portion, a through opening thereby being formed in the intermediate portion between the slotted hole and the cut away portion, a curved wall being formed between the cut away portion and the slotted hole, said speculum having no movable parts, wherein the speculum being inserted between the upper mandible and the lower manible of the bird, the cut away portion being juxtapositioned to the lower mandible, the second longitudinal surface being juxtapositioned to the upper mandible, the speculum being rotated through approximately 90°, thereby separating the mandibles such that the slotted hole is oriented inwardly toward the bird and the cut away portion is oriented outwardly from the bird, with the through opening oriented between the mandibles such that oral access to the bird is gained by means of the through opening.

13. The speculum of claim 12 further comprising a segment being formed on the second longitudinal surface between the slotted hole and the end opposite the handle.

14. A veterinary oral speculum for use with a bird, having an upper mandible and lower mandible, the speculum comprising:

a rod having a handle, an intermediate portion, an end opposite from the handle, a first longitudinal surface and a second opposite longitudinal surface, the intermediate section having a cut away portion formed in the first longitudinal surface between the handle and the end, the intermediate section further having a slotted hole formed in the second longitudinal surface in juxtaposition to the handle, the slotted hole being opposed to and communication with the cut away portion, a through opening thereby being formed in the intermediate portion between the slotted hole and the cut away portion, wherein the speculum being inserted between the upper mandible and the lower mandible of the bird, the cut away portion being juxtapositioned to the lower mandible, the second longitudinal surface being juxtapositioned to the upper mandible, the speculum being rotated through approximately 90°, thereby separating the mandibles such that the slotted hole is oriented inwardly toward the bird and the cut away portion is oriented outwardly from the bird, with the through opening oriented between the mandibles such that oral access to the bird is gained by means of the through opening, wherein the cut away portion and the slotted hole each have a respective length, the length of the slotted hole being less than the length of the cut away portion.

15. A veterinary oral speculum for use with a bird, the speculum comprising:

a cylinder having a first end and an opposite second end, a first surface and an opposite second surface, the surfaces extending between the first end and the second end, a longitudinal slotted opening being formed on the first surface of the cylinder and a longitudinal cut away portion being formed on the opposite second surface of the cylinder, the slotted opening communicating with the cut away portion and defining a transverse through opening in the cylinder, the cut away portion and the slotted hole each having a respective length, the length of the cut away portion being greater than the length of the slotted hole, wherein the speculum being inserted between an upper mandible and a lower mandible of the bird, the cut away portion being juxtapositioned to the lower mandible, the first surface being juxtapositioned to the upper mandible, the speculum being rotated through approximately 90°, thereby separating the mandibles such that the slotted hole is oriented inwardly toward the bird and the cut away portion is oriented outwardly from the bird, with the through opening oriented between the mandibles as a window such that access to the bird is gained by means of the through opening.

* * * * *